US006263897B1

(12) United States Patent
Saeki et al.

(10) Patent No.: US 6,263,897 B1
(45) Date of Patent: Jul. 24, 2001

(54) SLIDE VALVE PLATE AND METHOD OF MAKING THE SAME

(75) Inventors: Tsunenobu Saeki; Yuji Yoshimura, both of Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

(21) Appl. No.: 09/417,367

(22) Filed: Oct. 13, 1999

(30) Foreign Application Priority Data

Oct. 13, 1998 (JP) ..... 10-290200

(51) Int. Cl.[7] ..... B22D 41/28
(52) U.S. Cl. ..... 137/15.18; 222/590; 222/600
(58) Field of Search ..... 137/315, 315.27, 137/315.29, 15.23, 15.18; 222/590, 600

(56) References Cited

U.S. PATENT DOCUMENTS 5,020,703 * 6/1991 McQuillen, Jr. et al. ..... 222/600 X
5,284,278 * 2/1994 Waltenspuhl ..... 222/600 X
5,529,227 * 6/1996 Yoshikawa et al. ..... 222/590
5,730,892 * 3/1998 Niwa et al. ..... 222/590

* cited by examiner

*Primary Examiner*—Kevin Lee
(74) *Attorney, Agent, or Firm*—Sughrue, Mion, Zinn, Macpeak & Seas, PLLC

(57) ABSTRACT

The slide valve plate comprises the plate main body 11 and the sleeve 13 having the jaw part fitted in the through hole 12 formed in the plate 12, and the plate 11 and the sleeve 13 are integrally joined with the mortar, while the releasing member 15 is interposed between the part corresponding to the jaw part of the sleeve and/or the vicinity of the edge part of the through hole and the jaw part of the sleeve and/or the vicinity of the jaw part.

4 Claims, 4 Drawing Sheets

SLIDE VALVE PLATE AND METHOD OF MAKING THE SAME

BACKGROUND OF THE INVENTION

1. Field of the Invention

This invention relates to a slide valve plate (hereinafter sometimes referred to simply as "plate"), and in particular, a slide valve plate suited to re-use (recycle) and a method of making the same.

2. Description of the Related Art

Conventionally, a new plate for controlling the discharging amount of a molten metal from a molten metal vessel is in general mainly composed of a stationary plate and a movable plate which are secured by metal fixtures to a lower part of the molten metal vessel, and the movable plate is secured with a nozzle at its lower part.

The movable plate is slidingly contacted to the stationary plate, so that orifices formed therein are made agree to discharge the molten metal, or are made disagree to control or stop the issue of the metal.

The plate suffers serious damages by the molten steel while using, and recently from economical pointview, it has eagerly been demanded for its re-using, and there have already been proposed several methods therefor.

FIG. 4 shows a plate capable of re-using. For example, the orifices are especially seriously damaged in the movable plate S or the stationary plate K of the used plate and are hollowed out in circle by a boring process so as to form a through hole 42 into which a cylindrical straight ring 43 is engaged and inserted. Then, the sliding face of the plate is ground to fall into tolerance of the same smoothness as that of a new plate. As a cushioning plate to be furnished to a non-sliding face of the plate, the same cushioning plate as a firstly used cushioning plate is re-used. In FIG. 4, numerals 41, 42 and 44 represent a plate main body, a through hole, an orifice, respectively.

However, according to this method, there was a risk that the straight ring 43 fitted in the through hole 42 would slip out while working.

For improving such matter, when re-producing the through hole of the movable plate S, the overall orifices of the molten metal in the plate are hollowed out, and a cylinder having a ring shaped jaw part is inserted therein and fixed with a mortar (JP-A-5-200531).

As the method disclosed in JP-A-5-200531 inserts the cylinder having the ring shaped jaw part in the hollowed parts and fixes with the mortar, the cylinder can advantageously be prevented from slipping out as happening conventionally, but when removing the cylinder having the damaged ring shaped jaw part and inserting a cylinder having a new ring shaped jaw part so as to fix with the mortar, problems involved are that it is difficult to remove the cylinder of the damaged jaw part, and at the same time the plate itself might be injured.

Especially, when the connection between the jaw part and the plate is cancelled, the plate is injured so that a grinding amount of the plate is increased by the injured amount, and such a problem occurs that difficulty is increased in grinding the sliding face of the plate to fall into tolerance of the same smoothness as that of a new one.

Further, by increasing of the grinding amount, the thickness of the plate is decreased and accordingly the strength thereof is lowered.

The invention has been realized in view of such problems.

SUMMARY OF THE INVENTION

It is an object of the invention to offer a slide valve plate where it is easy to remove a sleeve having a damaged jaw part with less breakage in the plate face and injury in the edge part of the through hole, and it is easy to grind the plate face for re-using of the plate.

In view of re-using the plate, inventors of this patent application made investigations and studies on conditions of connecting and separating of the sleeve having the jaw part and the plate, and have found the followings and accomplished the invention.

(1) With respect to damages in the plate caused when separating the sleeve and the plate, the damage caused in a part corresponding to the sleeve has less problems in the grinding work for removing the damage and re-using in comparison with the damages caused in the part corresponding to the jaw part and in the edge of the through hole.

(2) With respect to the connection between the sleeve and the plate, even if an extent of the connection at the jaw part is weak but if it is strong at the sleeve, the connection is sufficient as a whole.

That is, the inventive slide valve plate for controlling an amount of a molten metal flowing, comprising a slide valve plate main body having a through hole (penetrating hole) at a part corresponding to a molten metal orifice and a sleeve having a jaw part to be fitted in the through hole, is characterized by interposing a releasing member between the surface of the plate main body and/or the vicinity of an edge of the through hole and the jaw part of the sleeve and/or the vicinity of the jaw part (a first aspect of the invention) . This is a subject matter of the invention, and in particular, the invention is preferably characterized in that the releasing member is a parchment paper (a second aspect of the invention).

Further, the inventive method of making a slide valve plate for controlling an amount of a molten metal flowing, comprising the slide valve plate main body having a through hole at a part corresponding to a molten metal orifice and the sleeve having the jaw part, is characterized by comprising the steps of:

A. turning upward an injured sliding face of a used slide valve plate, punching the sleeve having the jaw part through the through hole, and adjusting the through hole after having punched the sleeve through the through hole;

B. setting a releasing member at a part corresponding a jaw part of a new sleeve and/or the vicinity of the edge part of the through hole, around the through hole of the surface of the used plate main body after having punched the sleeve through the through hole, otherwise coating or blowing a solution for forming the releasing member, and thereafter fitting the new sleeve in the through hole of the plate main body, and joining and integrating (integrally joining) them with a mortar; and C. grinding the face of an opposite side to the injured sliding face of the used plate fitted with the new sleeve so as to form a new sliding face (a third aspect of the invention).

The above steps define the inventive items.

Still further, the inventive method of making a slide valve plate for controlling an amount of a molten metal flowing, comprising a slide valve plate main body having a through hole at a part corresponding to a molten metal orifice and the sleeve having the jaw part to be fitted in the through hole, is characterized by comprising the steps of: setting a releasing member at a part corresponding a jaw part of a new sleeve and/or the vicinity of the edge part of the through hole, around the through hole of a new slide valve plate main body, otherwise coating or blowing a solution for forming the releasing member; and thereafter fitting the new sleeve in the through hole of the plate main body and joining and integrating them with a mortar (a fourth aspect of the invention).

The above steps define the further inventive items.

DETAILED DESCRIPTION OF THE INVENTION

In the slide valve plate for controlling the amount of the molten metal flowing, the inventive slide valve plate is characterized by interposing the releasing member between the plate main body and the jaw part of the sleeve to be fitted in the through hole of the plate and integrally joining them.

The releasing member referred to herein is a substance to be vanished by heating, and has oilproof, waterproof or no water permeability.

The invention will be explained in detail, referring to the attached drawings.

Figure 1A:
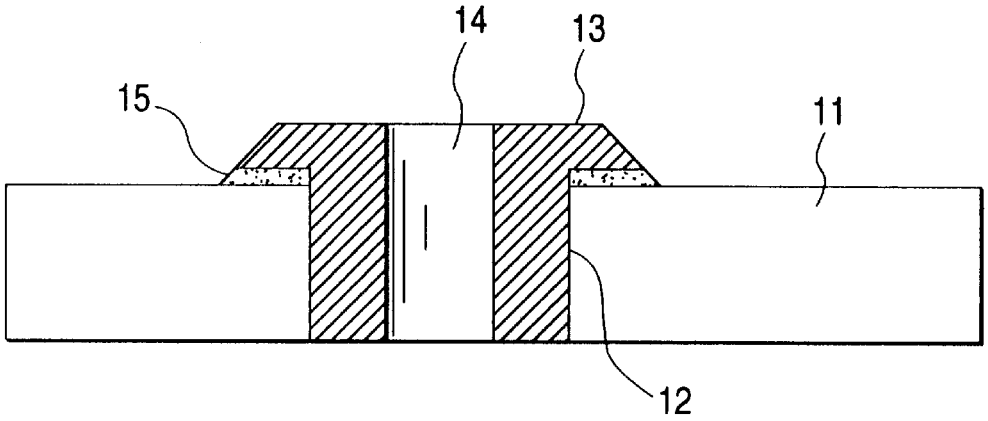
FIG. 1A and 1B are cross sectional views showing embodiments of the slide valve plates of the invention.
Figure 1B:
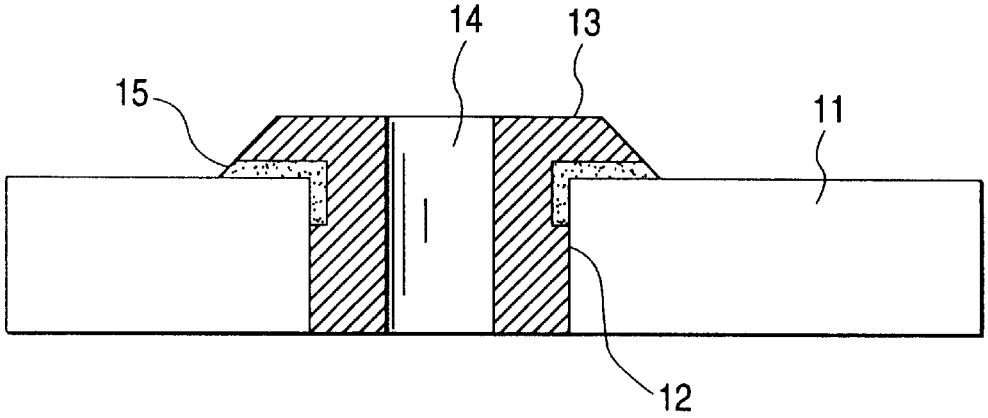

FIGS. 1A and 1B are cross sectional views showing embodiments of the slide valve plates of the invention.

Figure 2A:
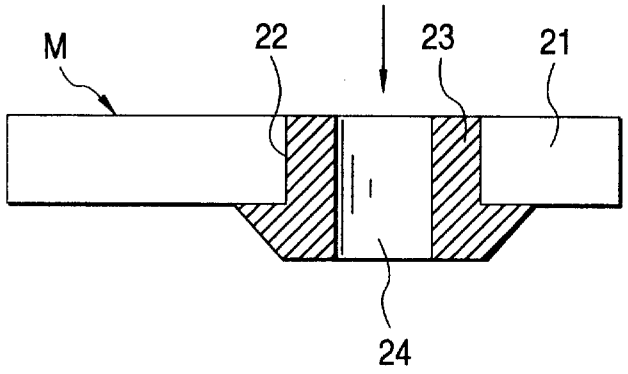
FIG. 2A to 2C are cross sectional views showing a processing order of the embodiment of making the slide valve plate.
Figure 2B:
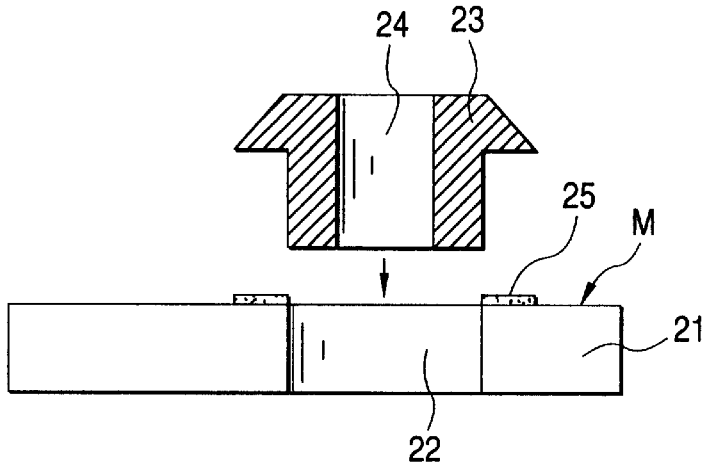
Figure 2C:
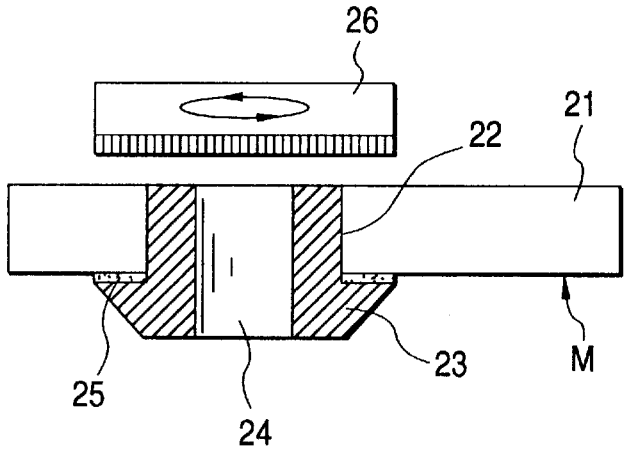

FIGS. 2A to 2C are cross sectional views showing a processing order of one embodiment for making the inventive slide valve plate.

The slide valve plate of the invention, as shown in FIGS. 1A and 1B, comprises the plate main body 11 and the sleeve 13 having the jaw part fitted in the through hole 12 formed in the plate 11.

The plate 11 and the sleeve 13 are integrally connected with the mortar, and the releasing member is interposed between the part corresponding to the jaw part of the sleeve and/or the vicinity of an edge of through hole and the jaw part of the sleeve and/or the vicinity of the jaw part, around of the through hole 12 of the surface of the plate 11.

The plate 11 to be used in the invention may be a new one or once or more used one.

When the once used plate 11 is used, it may be a plate having a projected part at the orifice of the molten metal or a plate formed to be flat in both sliding and fixed faces.

In addition, when the once or more used plate 11 is used, the opposite face to the face (injured face M) which was used as a sliding face is ground to form a new smoothly sliding face, and the face to be new sliding face should be ground to have the same smoothness as that of a new plate falling into tolerance.

When the once or more used plate 11 is used, a plate for cushioning having the same thickness as the cut amount for forming the sliding face may be provided on the opposite face (injured face M) to the face to be a new sliding face for the plate 11.

The plate 11 is formed with a circular or polygonal through hole 12 for receiving the sleeve 13 having the jaw part.

The through hole 12 may have the same size in a full length corresponding to the thickness of the plate 11 or may be formed with a step portion for receiving the jaw part of the sleeve 13.

The plate 11 may be furnished at its periphery with a steel band for avoiding deformation by cracks caused in the plate.

Known heat or fire resistant ceramics are used as materials for the plate 11.

For example, there are enumerated alumina, alumina carbon, alumina silica, zirconia, zirconia carbon, alumina silica carbon, magnesia, magnesia carbon, or magnesia chromium.

The plate main body may be treated with tar impregnation, if required.

The sleeve 13 to be used in the invention is provided with the jaw part at its one end and formed with the orifice 14 of the molten metal flowing in the center thereof.

The cross section of the sleeve is formed to be circular or polygonal in response to the cross section of the through hole 12 formed in the plate 11.

The cross sectional shape of the jaw part may be the same as or different from that of the sleeve, but when the jaw part goes into the step portion of the through hole 12, it is formed in the same circular or polygonal shape as that of the through hole 12.

The sleeve 13 may be provided with a gas supply hole for supplying gas.

Materials of the sleeve 13 may be the same as or different from that of the plate, and are known heat or fire resistant ceramics.

For example, there are enumerated alumina, alumina carbon, magnesia, zirconia, alumina silica, alumina silica carbon, zirconia carbon, magnesia carbon, or magnesia chromium.

Figure 3A:
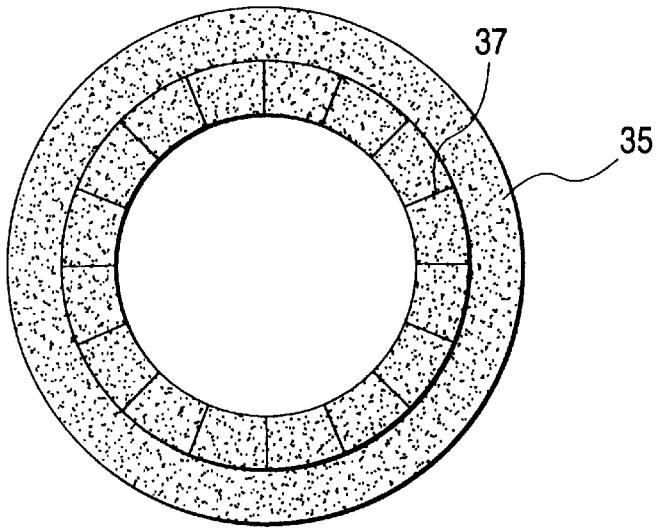
FIG. 3A is a plan view showing one embodiment of the releasing member to be used in the invention.

The releasing member to be set between "the surface of the plate main body and/or the vicinity of the edge part of the through hole" and "the jaw part of the sleeve and/or the vicinity of the jaw part" has, for example, the same sheet shape as the cross section of the jaw part of the sleeve 13 or 23 and has a slightly larger hole than the through hole 12 or 22 formed in the plate 11 or 21, otherwise, as shown in FIG. 3A, the releasing member has a slightly smaller hole than the through hole 32 formed in the plate 31, and may cuts 37 are provided from the hole in the outer peripheral direction so that the releasing member is able to be bent by the cutting depth.

Figure 3B:
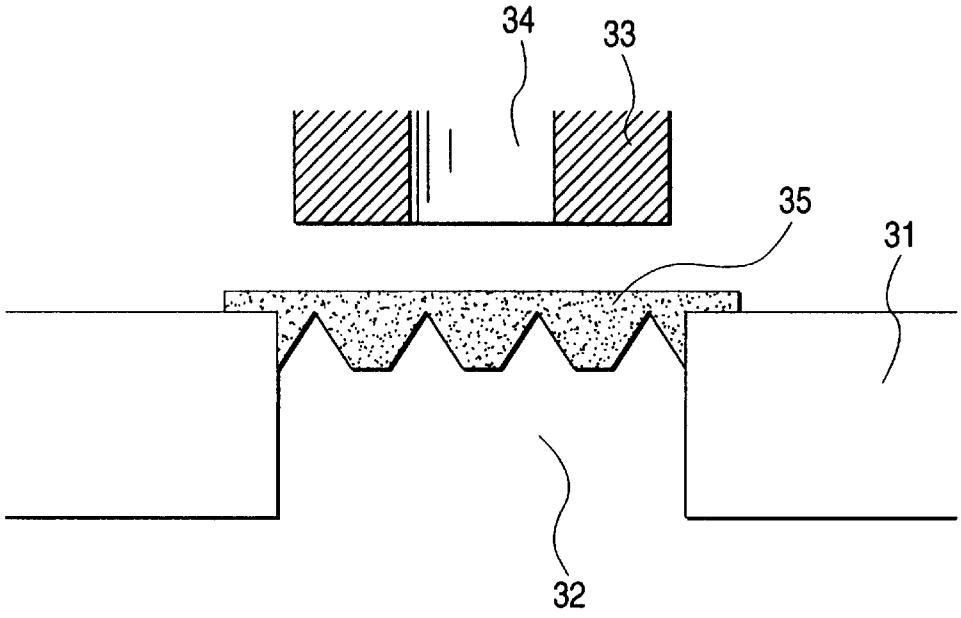
FIG. 3B is a cross sectional view showing a condition that the releasing member is set to the plate main body.
Figure 4:
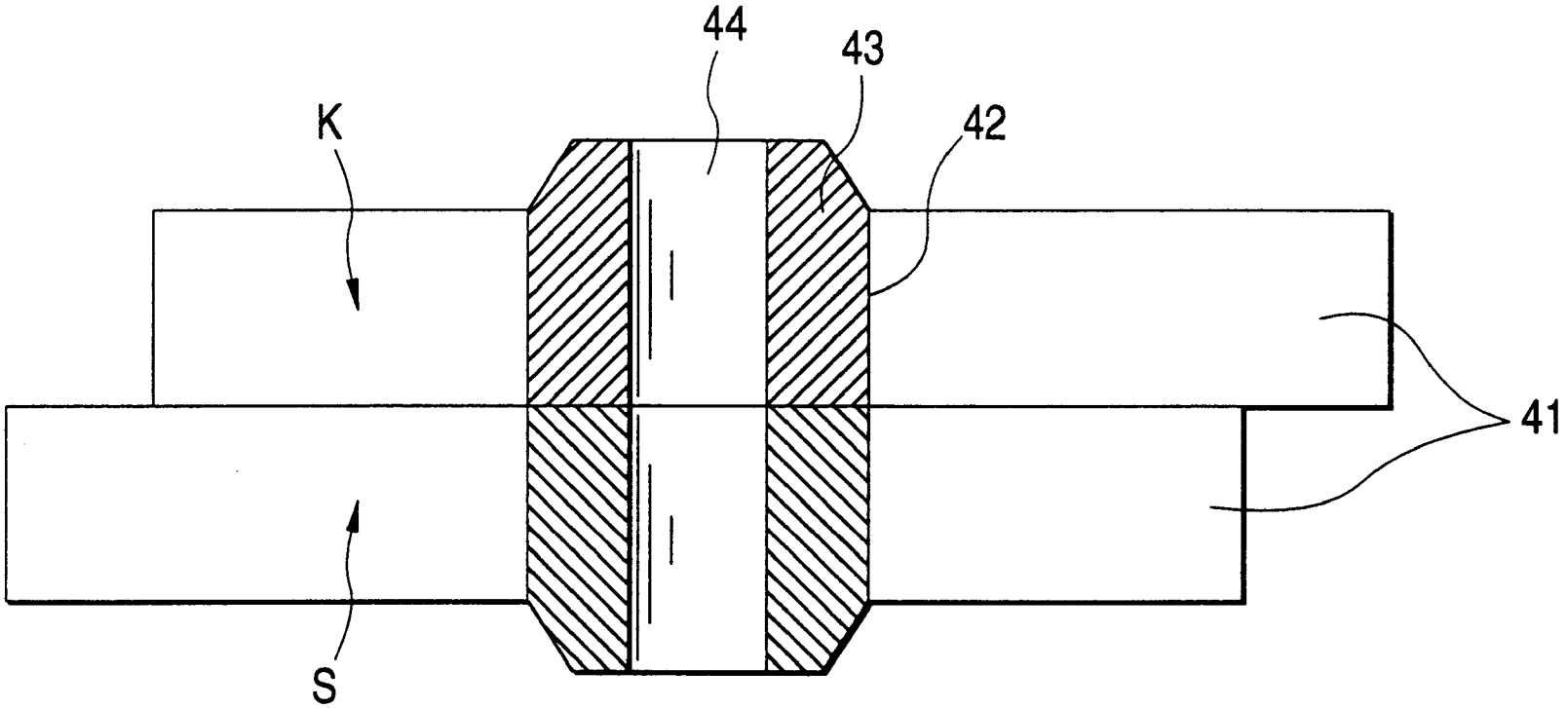
FIG. 4 is a cross sectional view showing the conventional slide valve plate.

When using the releasing member as shown in FIG. 3A, it is set in the through hole 32 of the surface of the plate 31 under a condition that the releasing member is bent by the cut depth 37 as seen in FIG. 3B. In FIG. 3B, numerals 33 and 34 represent a sleeve having a jaw part and an orifice, respectively.

As materials for forming the releasing member 15, there are enumerated the parchment paper, or various kinds of synthetic resins such as polyethylene, nylon, polyvinyl chloride, polyester, epoxy resin, or phenol resin.

The releasing member to be set between "the surface of the plate main body and/or the vicinity of the edge part of the through hole" and "the jaw part of the sleeve and/or the vicinity of the jaw part" is not limited to the sheet shapes, but may be formed by coating or blowing a solution of a wax or the synthetic resin.

The method of making the slide valve plate according to the invention comprises:

A. turning upward an injured sliding face of a used slide valve plate 21, punching the sleeve 23 having the jaw part, through the through hole 22, and adjusting by grinding the through hole 22 after punching the sleeve;

B. setting a sheet shaped releasing member 25 or 35 at a part corresponding a jaw part of a new sleeve 23 and/or the vicinity of the edge part of the through hole, around the through hole 22 of the surface of the used plate main body 21 after punching the new sleeve 23, otherwise coating or blowing a solution for forming the releasing member and thereafter fitting the new sleeve 23 in the through hole 22 of the plate main body 21 and integrally joining them with a mortar; and C. grinding a face of an opposite side to the sliding face (injured face M) of the used plate fitted with the new sleeve 23 so as to form a new sliding face.

Still further, another inventive method of making the slide valve plate is to set a sheet shaped releasing member 15 or 35 at a part corresponding to a jaw part of a new sleeve 13 and/ or the vicinity of the edge part of the through hole, around the through hole 12 of the new slide valve plate main body 11 (the plate may be such a plate that after a plate having a projected part around an orifice is once used, a though hole is formed by enlarging the orifice by cutting it including the projected part, and then grinding is effected to both face of the plate to form a new plate) , and otherwise coating or blowing a solution for forming the releasing member and thereafter fitting said new sleeve in the through hole of the plate main body and integrally joining them with a mortar.

Examples of the invention will be shown with comparative examples for explaining the invention practically, but the invention should not be limited to the following examples.

EXAMPLE 1

As seen in FIG. 1, a new plate main body 11 was made of a ceramic of $Al_2O_3$80%, $SiO_2$10% and C 10% and parallel in both faces. A parchment paper 15 having a slightly larger hole than the through hole 12 was set therearound on one face of the plate 11, and a new sleeve 13 having a jaw part made of the ceramic of $Al_2O_3$80%, $SiO_2$10% and C 10% was fitted in the through hole 12 and was integrally joined to produce a slide valve plate.

EXAMPLE 2

As seen in FIG. 2A, a once used plate main body 21 was made of a ceramic of $Al_2O_3$80%, $SiO_2$10% and C 10%, parallel in both faces and provided with a sleeve 23 having a jaw part. Turning reversely the plate 21 so that the sliding face (injured face) M was upward, punching the sleeve 23 having the jaw part through the through hole 22, grinding the hole 22 to remove the mortar therein, disposing the releasing member 25 around the hole 22 of the sliding face (injured face) M, fitting a sleeve 23 having a new jaw part made of a ceramic of $Al_2O_3$80%, $SiO_2$10% and C 10% in the hole 22, and integrally joining them with the mortar, the slide valve plate was thus produced. In FIGS. 2A to 2C, numerals 24 and 26 represent an orifice and a grinding tool, respectively.

Comparative Example 1

The slide valve plate was obtained in the same manner as the Example 1, excepting that the releasing member was not arranged.

Comparative Example 2

The slide valve plate was obtained in the same manner as the Example 2, excepting that the releasing member was not arranged.

With respect to the slide valve plates obtained in the Examples 1, 2 and the Comparative Examples 1, 2 (each 10 sheets of plates), investigations were made on occurrence rate (first time) of defects caused in the edge parts when punching the sleeves through the through holes as well as frequency of re-using the plates.

Results are as shown in Table 1.

TABLE 1

| | Ex. 1 | Ex. 2 | Com. 1 | Com. 2 |
|---|---|---|---|---|
| Defects (%) in edges | 0.8 | 0.9 | 9.8 | 10.1 |
| Number of re-use times | 4 | 4 | 2 | 1 |

Note: Ex.: Example and Com: Comparative Example

From the tested results, it is apparent that the sleeve is easily removed from the plate main body in the slide valve plate and injuries at parts of joining the plate and the jaw part are lower in Examples 1 and 2 in comparison with the Comparative Examples.

Further, excellent effects were recognized that the re-using rates and times of the plate were heightened.

As mentioned in detail, in the invention, the releasing member is interposed between the plate main body and the jaw part of the sleeve to be fitted in the through hole so as to integrally join them, whereby the removal of the sleeve after using from the plate is made easy, and injuries at parts of joining the plate and the jaw part are lowered, so that the grinding work including injured parts are easy and the re-using times may be increased.

What is claimed is:

1. A slide valve plate for controlling an amount of a molten metal flowing, comprising: a slide valve plate main body having a through hole at a position corresponding to a molten metal orifice; and a sleeve having a jaw part to be fitted in the through hole, wherein a releasing member is interposed i) between the plate main body and the jaw part of the sleeve and between the plate main body and a corner part of the sleeve, ii) between the plate main body and the jaw part of the sleeve, or iii) between the plate main body and the corner part of the sleeve.

2. The slide valve plate according to claim 1, wherein the releasing member is a parchment paper.

3. A method of making a slide valve plate for controlling an amount of a molten metal flowing, the slide valve plate comprising a slide valve plate main body having a through hole at a position corresponding to a molten metal orifice and a sleeve having a jaw part to be fitted in the through hole, which comprises the steps of:

A. turning upward an injured sliding face of a used slide valve plate, punching the sleeve having the jaw part through the through hole, and adjusting the through hole;

B. one of i) setting a releasing member at a position corresponding to at least one of a jaw part of a new sleeve or a corner part of a new sleeve, around the through hole of the surface of the used plate main body, or ii) coating or blowing a solution for forming the releasing member at a position corresponding to at least one of a jaw part of a new sleeve or a corner part of a new sleeve, around the through hole of the surface of the used plate main body; and thereafter fitting the new sleeve in the through hole of the plate main body and integrally joining the new sleeve and the plate main body with a mortar; and C. grinding a face of an opposite side to the injured sliding face of the used plate fitted with the new sleeve so as to form a new sliding face.

4. A method of making a slide valve plate for controlling an amount of a molten metal flowing, the slide valve plate comprising a slide valve plate main body having a through hole at a position corresponding to a molten metal orifice and a sleeve having a jaw part to be fitted in the through hole, which comprises the steps of:

one of i) setting a releasing member at a position corresponding to at least one of a jaw part of a new sleeve or a corner part of a new sleeve, around the through hole of the surface of the used plate main body, or ii) coating or blowing a solution for forming the releasing member at a position corresponding to at least one of a jaw part of a new sleeve or a corner part of a new sleeve, around the through hole of the surface of a new slide value plate main body; and thereafter fitting the new sleeve in the through hole of the plate main body and integrally joining the new sleeve and the plate main body with a mortar.

* * * * *